United States Patent [19]

Schier, Jr. et al.

[11] Patent Number: 4,511,871

[45] Date of Patent: Apr. 16, 1985

[54] MODIFIED DEFLECTION YOKE COILS HAVING SHOOTBACK WINDINGS

[75] Inventors: John H. Schier, Jr., Greenwood; William E. Brooks, Jr., Indianapolis, both of Ind.

[73] Assignee: RCA Corporation, Princeton, N.J.

[21] Appl. No.: 514,988

[22] Filed: Jul. 18, 1983

[51] Int. Cl.[3] ..... H01F 5/00

[52] U.S. Cl. ..... 335/213; 335/210

[58] Field of Search ..... 335/210, 213; 313/421, 313/426, 428

[56] References Cited

U.S. PATENT DOCUMENTS

| | | | |
|---|---|---|---|
| 3,643,125 | 2/1972 | Torsch et al. | 315/24 |
| 3,643,192 | 2/1972 | Chiodi | 335/213 |
| 3,757,262 | 9/1973 | Over et al. | 335/213 |
| 4,038,621 | 7/1977 | Chiodi et al. | 335/213 |
| 4,128,824 | 12/1978 | Mirsch | 335/213 |
| 4,228,413 | 10/1980 | Campbell et al. | 335/213 |
| 4,329,671 | 5/1982 | Gross et al. | 335/213 |

*Primary Examiner*—George Harris

*Attorney, Agent, or Firm*—Paul J. Rasmussen; Joseph Laks; Scott J. Stevens

[57] ABSTRACT

A vertical coil for a television deflection yoke comprises a plurality of winding emplacements or layers wound in a shootback manner. The abrupt change in wire direction following the shootback winding tends to cause displacement of the initial turns of the subsequent winding emplacements. In order to prevent this displacement, the coil winding emplacements are wound with progressively greater winding angles so that the initial turn of each subsequent emplacement lies along the core surface and abuts the previous winding emplacements. The presence of the previous emplacements obstructs and prevents movement of the initial wire turns of each winding emplacement which allows the coil to be wound without the need for winding shootback straps or core end rings.

8 Claims, 8 Drawing Figures

MODIFIED DEFLECTION YOKE COILS HAVING SHOOTBACK WINDINGS

This invention relates to the winding of coils for television deflection yokes and, in particular, to the winding of vertical deflection coils without the use of wire placement aids.

Modern color television receivers incorporate self-converging display systems in which red, green, and blue designated electron beams produced by a color kinescope or picture tube are made to converge at all points on the kinescope display screen without the need for dynamic convergence circuitry. The deflection yoke, which deflects the beams to form the desired scanned raster on the kinescope display screen, produces deflection fields which also act to converge the beams. The deflection fields are nonuniform in the beam deflection region; consequently, the spatially separate electron beams may each experience different deflection field intensities at a given time, which results in a desired convergence of the beams at the kinescope display screen. In particular, for proper beam convergence, the horizontal deflection coils should produce a deflection field having a pincushion shape (viewed along the kinescope longitudinal axis) and the vertical deflection coils should produce a deflection field having a barrel shape.

The vertical deflection coils may be formed by wire turns being toroidally wound on a magnetically permeable ferrite core with the wire being carried by a flyer of a winding machine. The desired deflection field nonuniformity is produced by forming the deflection coils in a plurality of layers, with the layers occupying different winding angles or arcuate regions on the core. After a given layer of wire turns are wound on the core, the wire is returned to its starting point and a subsequent layer of wire turns is wound. The wire may be returned to its starting point by the shootback method in which the return winding follows a generally direct path along the outside of the core, or the spiral back method, in which the return winding follows a more gradually toroidal path about the core.

The abrupt change in wire direction when using the shootback method of winding may cause the winding turns near the ends of the winding layer to slip or be pulled out of position. Consequently, yokes which utilize the shootback method may require the use of shootback straps located at the ends of the core and incorporating slots or tabs to hold the wire turns in place, or the use of glue or other adhesive, such as hot melt glue, to bond the end wire turns of the coil winding layer in place. The use of shootback straps appreciably adds to the cost of the deflection yoke, while glue increases the manufacturing complexity and time required for construction of the yoke.

The spiral back winding method permits the yoke to be constructed without the previously described constraints; however, the presence of the spiraling return winding along the inside of the core in the active deflection region may cause interfering fields which may adversely affect the performance of the deflection yoke.

The present invention is directed to a deflection yoke which may be wound using a shootback winding return method without the need for shootback straps and wire bonding adhesive.

In accordance with the present invention, a deflection yoke comprises a magnetically permeable core and a deflection coil toroidally wound on the core. The deflection coil comprises a first winding emplacement comprising a plurality of wire turns and occupying an arcuate region on the core. At least one additional winding emplacement is wound after the first winding emplacement and incorporates a plurality of winding turns that overlay the first winding emplacement. At least one wire turn of the additional winding emplacement extends beyond the end of the first winding emplacement and lies level with the wire turns thereof such that lateral displacement of the extending wire turn is obstructed by the presence of the first winding emplacement.

In the accompanying drawing.

Figure 1:
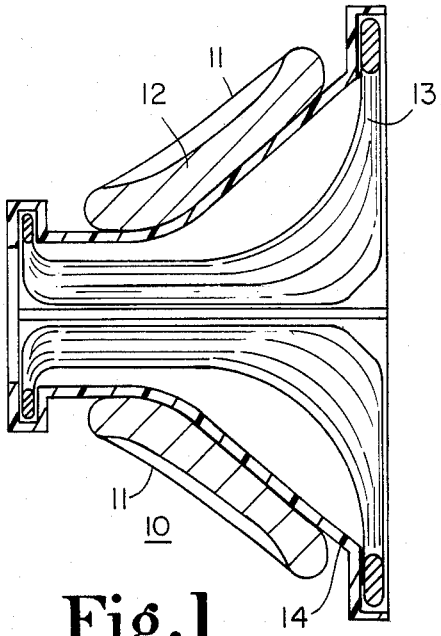
FIG. 1 is a side elevational cross-sectional view of a television deflection yoke.

Referring to FIG. 1, there is shown a deflection yoke 10 comprising a pair of vertical deflection coils 11 toroidally wound on a magnetically permeable core 12, and a pair of saddle type horizontal deflection coils 13. A plastic insulator 14 electrically and physically separates the vertical and horizontal deflection coils and may provide support and alignment structure not generally illustrated for the coils and the core.

The toroidally wound vertical deflection coils comprise a plurality of winding layers on each half of the magnetically permeable core. The individual winding layers occupy or subtend different winding angles or arcuate regions on the core in order that the deflection field produced by the deflection coils has the desired degree of nonuniformity necessary to converge the electron beams. The coil on each core half is wound in a continuous fashion with a layer being completely wound before a subsequent layer is begun.

Figure 2:
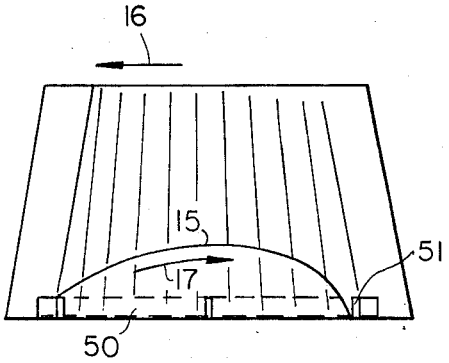
Fig.2 PRIOR ART
FIG. 2 is a side elevational view of a vertical deflection coil, illustrating a prior art shootback winding technique.

The wire is returned to the starting point for the next winding layer generally in one of two ways. One way is known as the shootback method, as shown in FIG. 2, in which a return winding 15 follows a generally direct path, indicated by arrow 17, along the outside of the core from the end of one winding layer, wound in a direction indicated by arrow 16, to the beginning of the next winding layer. The abrupt change in direction of travel of the wire at the beginning of each winding layer causes the initial turns of the winding layer to slip or become displaced laterally along the core surface, which may require the use of a shootback strap 50. Shootback strap 50 incorporates one or more radially extending tabs 51, around which the wire is routed.

Figure 3:
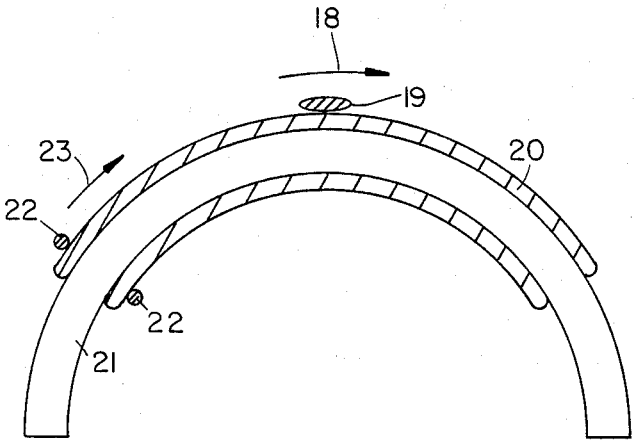
Fig.3 PRIOR ART
FIG. 3 is a front elevational cross-sectional view of a portion of a vertical deflection coil of the prior art.

The reason that the initial wire turns tend to slip is shown in FIG. 3 by arrow 18 which shows the direction of winding of the wire turns of each winding layer. FIG. 3 illustrates a prior art winding technique in which a winding layer 20 (shown schematically in cross section) is toroidally wound on a core 21 using the shootback technique. A shootback winding 19 is shown in cross section along the outside of core 21 and winding layer 20. The initial wire turn 22 of the subsequent winding layer is shown subject to a force indicated by arrow 23 which tends to undesirably displace the wire turn. Because of this tendency toward movement or displacement of the initial wire turn or turns of each of the subsequent winding layers, which may cause undesirable changes in the deflection field, coils wound using the shootback method may require additional structure such as deflection yoke end rings or shootback straps (not shown) which provide slots or channels for the wire turns or protruding posts about which the winding turns can be placed in order to hold it in position. This additional structure adds to the cost and manufacturing complexity of the yoke.

Figure 4:
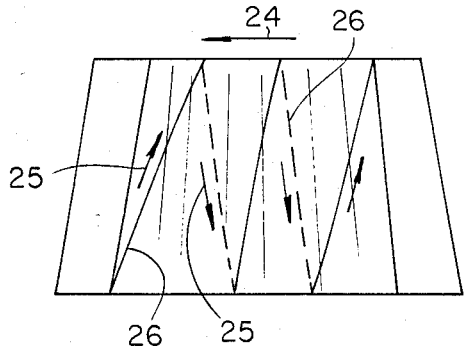
Fig. 4 PRIOR ART
FIG. 4 is a side elevational view of a vertical deflection coil, illustrating a prior art spiral back winding technique.

As an alternative, the deflection coils may be wound using a technique known as the spiral back method, as illustrated in FIG. 4. Arrow 24 illustrates the direction in which the winding layer is wound. Arrows 25 illustrate the path that the return winding 26 takes to reach the point at which the subsequent winding layer is started. Return winding 26 follows a widely spaced toroidal or spiral path that encircles the core several times. As can be seen, the change in wire direction at the beginning of each winding layer is much less abrupt with the spiral back method than with the shootback method. As a result, spiral back coils may be wound without the need for wire positioning structure, such as core end rings. The spiral back coil, however, because a portion of the return winding lies along the inside or active region of the core, may introduce undesirable harmonics into the deflection field, causing unwanted ringing of the deflection current.

Figure 5:
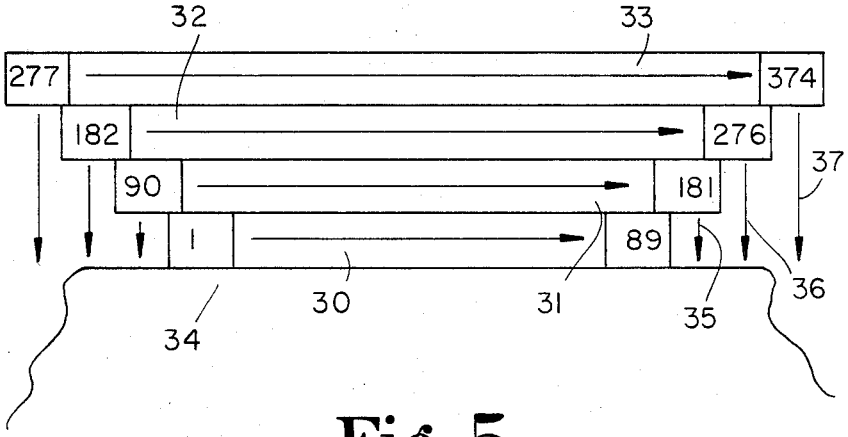
FIG. 5 illustrates a winding distribution of a vertical deflection coil in accordance with the present invention.

Referring to FIG. 5, there is shown a schematic representation of a deflection coil winding distribution in accordance with the present invention, illustrating an inverted pyramid arrangement. The deflection coil incorporates a plurality of winding layers or emplacements 30, 31, 32, and 33 toroidally wound on a core 34 using a shootback method without the need for additional wire holding and positioning structure. Successive winding emplacements 30, 31, 32 and 33 of the deflection coil are schematically shown as subtending progressively greater winding angles or arcuate regions of the core. In particular, winding emplacement 31 will occupy a greater winding angle than winding emplacement layer 30. Likewise winding emplacements 32 and 33 subtend progressively greater winding angles. The number of wire turns for each emplacement shown in FIG. 5, are given for illustrative purposes only and other numbers of wire turns or distributions are possible.

Emplacement 30 is wound on the surface of core 34. Emplacement 31 is wound to overlay emplacement 30. However, as can be seen in FIG. 5, some of the turns at each end of winding emplacement 31 extend beyond the ends of winding emplacement 30. These turns will be pulled by the tension exerted by the winding machine flyer toward the core 34 in the direction of arrows 35. The turns at the ends of emplacement 31 will therefore lie along the surface of core 34 while the remainder of emplacement 31 will overlay emplacement 30. Likewise, some of the turns at each end of emplacement 32 and 33 will be pulled by the winding flyer against the core 34 in the direction of arrows 36 and 37, respectively.

Figure 6:
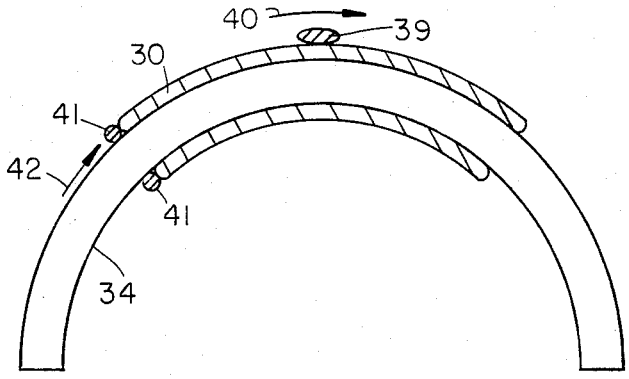
FIG. 6 is a front elevational cross-sectional view of a portion of a vertical deflection coil constructed in accordance with the present invention.

As previously described, the change in winding direction at the beginning of a new winding emplacement following the shootback of the wire along the outside of the previous winding emplacement tends to cause sideways or lateral displacement of the initial wire turns of the subsequent winding emplacement. As can be seen in FIG. 6, the deflection coil illustrated in FIG. 5 is not subject to this wire turn displacement. FIG. 6 schematically shows winding emplacement 30 toroidally wound on core 34. The shootback winding 39, occurring after emplacement 30 is wound, is shown in cross section. The wire winding direction is shown by arrow 40. The initial turn 41 of winding emplacement 31 lies along the surface of core 34. The force which attempts to displace wire turn 41 in a sideways or lateral direction, illustrated by arrow 42, will not cause any displacement of wire turn 41 because the presence of winding emplacement 30 acts as an obstruction to any movement of wire turn 41. The initial turns of subsequent winding emplacements 32 and 33 will also be prevented from moving or being displaced by the presence of the previously wound wire emplacements. By winding the coil winding emplacements with progressively greater winding angles, the initial turns of each winding emplacement will be effectively anchored in place by the previous winding emplacement.

Figure 7A:
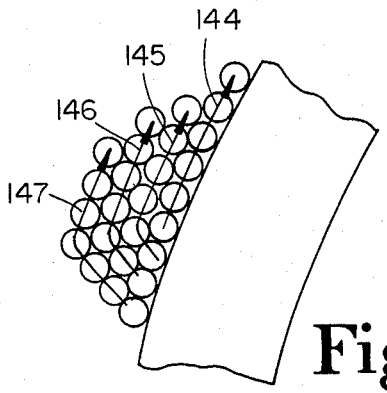
FIG. 7A is a portion of the deflection coil shown in FIG. 7, enlarged to show detail.
Figure 7:
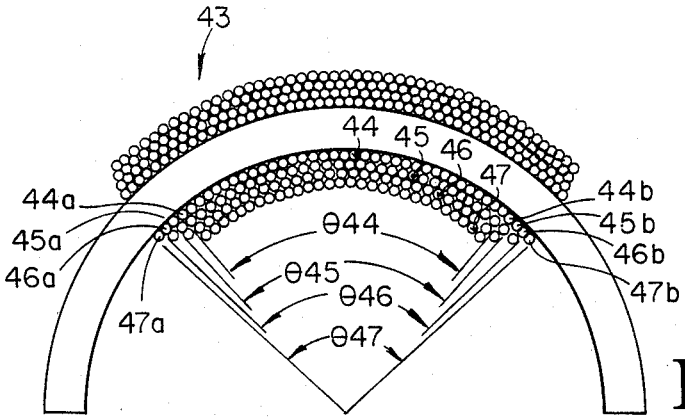
FIG. 7 is a representation of the winding layer distribution of a vertical deflection coil of the present invention.

FIG. 7 illustrates a coil 43 wound in accordance with the present invention. The progressively increasing winding angles of winding emplacements 44, 45, 46 and 47 are shown by the angles designated $\theta$44, $\theta$45, $\theta$46 and $\theta$47, respectively. The initial winding turn of each winding emplacement is designated 44*a*, 45*a*, 46*a* and 47*a*, respectively. The final winding turn is likewise designated 44*b*, 45*b*, 46*b* and 47*b*. Arrows 144, 145, 146 and 147, shown in FIG. 7A, generally indicate the contour of each of the winding emplacements 44, 45, 46, and 47, respectively. It can be seen that wire turns of a given winding emplacement will occupy different winding levels. For example, wire turns of the winding emplacement 47 occupy four different winding levels.

If desired, an adhesive may be applied to the core surface before winding to aid in maintaining the position of the wire turns, but this is not necessary. The advantages realized by the present invention apply to coils wound with either a radial or bias configuration.

The deflection coils wound utilizing the previously described novel inverted pyramid technique provide deflection fields substantially identical to those produced by conventional winding techniques, yet eliminates the requirement of wire placement aids.

What is claimed is:

1. A deflection yoke comprising:

a magnetically permeable core;

a deflection coil toroidally wound on said core comprising:

a first winding emplacement incorporating a plurality of wire turns occupying a first arcuate region on said core;

at least a first additional winding emplacement wound after said first winding emplacement and incorporating a plurality of wire turns that overlay said first winding emplacement, and incorporating at least one wire turn that extends beyond an end of said first winding emplacement and lies level with wire turns thereof such that lateral displacement of the extending wire turn is obstructed by the presence of said first winding emplacement.

2. The arrangement defined in claim 1, wherein the return winding between said first winding emplacement and said additional winding emplacement follows a substantially direct path along the outside of said core without extending along the inside of said core.

3. A deflection yoke comprising:

a magnetically permeable core;

a deflection coil toroidally wound on said core comprising a plurality of winding emplacements. each comprising a plurality of wire turns, a successive one of said plurality of winding emplacements overlaying a previous one of said plurality of winding emplacements such that the angle subtended by said successive winding emplacement is greater than the angle subtended by the previous winding emplacement.

4. A method for forming a coil of a deflection yoke comprising the steps of:

toroidally winding a wire about a magnetically permeable core in a plurality of wire turns of a first winding emplacement from a first wire turn position on the inside surface of said core through a first arcuate region to a second wire turn position on said inside surface;

returning said wire along the outer surface of said core from said second wire turn position to a third wire turn position beyond said first wire turn position to enable the first turn of a subsequent winding emplacement to be located level with the first turn of said first winding emplacement; and toroidally winding said wire about said core in a plurality of wire turns of said second winding emplacement from said third wire turn position through a second arcuate region.

5. The method for forming a coil defined in claim 4, wherein said subsequent winding emplacement forms an inverted pyramid arrangement with said first winding emplacement.

6. The method for forming a coil defined in claim 4, comprising the additional steps of winding said second winding emplacement through said second arcuate region greater than said first arcuate region and ending at a fourth wire turn position beyond said second wire turn position; returning said wire along the outer surface of said core from said fourth wire turn position to a fifth wire position beyond said third wire turn position to enable the first turn of a third winding emplacement to be located level with the first turns of said first and second winding emplacements and; toroidally winding said wire about said core in a plurality of winding turns of said third winding emplacement from said fifth wire turn position through a third arcuate region.

7. The method for forming a coil defined in claim 4, in which said second winding emplacement comprises wire turns occupying at least two winding levels with respect to said core, comprising the additional step of winding a third winding emplacement having a first turn located level with the first turns of said first and second winding emplacements and having wire turns occupying at least two winding levels with respect to said core.

8. A deflection yoke comprising:

a magnetically permeable core;

a deflection coil toroidally wound on said core comprising:

a first winding emplacement incorporating a plurality of wire turns occupying a first arcuate region on said core;

at least a first additional winding emplacement wound after said first winding emplacement and incorporating a plurality of wire turns that overlay said first winding emplacement, and incorporating at least one wire turn that extends beyond an end of said first winding emplacement and lies adjacent to the wire turns thereof such that lateral displacement of the extending wire turn is obstructed by the presence of said first winding emplacement.

* * * * *